US010563511B2

(12) United States Patent
Peeren et al.

(10) Patent No.: US 10,563,511 B2
(45) Date of Patent: Feb. 18, 2020

(54) METHOD FOR PROFILING A TURBINE ROTOR BLADE

(71) Applicant: Siemens Aktiengesellschaft, Munich (DE)

(72) Inventors: Christian Peeren, Berlin (DE); Stefan Schmitt, Mülheim an der Ruhr (DE); Ulrich Waltke, Mülheim an der Ruhr (DE); Heinrich Stüer, Haltern (DE)

(73) Assignee: Siemens Aktiengesellschaft, Munich (DE)

( * ) Notice: Subject to any disclaimer, the term of this patent is extended or adjusted under 35 U.S.C. 154(b) by 276 days.

(21) Appl. No.: 15/567,141

(22) PCT Filed: Apr. 18, 2016

(86) PCT No.: PCT/EP2016/058559
§ 371 (c)(1),
(2) Date: Oct. 17, 2017

(87) PCT Pub. No.: WO2016/173875
PCT Pub. Date: Nov. 3, 2016

(65) Prior Publication Data

US 2018/0100399 A1 Apr. 12, 2018

(30) Foreign Application Priority Data

Apr. 28, 2015 (EP) ..... 15165330

(51) Int. Cl.
*F01D 5/14* (2006.01)
*F01D 5/16* (2006.01)
*F04D 29/32* (2006.01)

(52) U.S. Cl.
CPC ..... *F01D 5/141* (2013.01); *F01D 5/16* (2013.01); *F04D 29/324* (2013.01); *F05D 2240/301* (2013.01); *F05D 2250/70* (2013.01)

(58) Field of Classification Search
CPC ..... F01D 5/141; F01D 5/16; F04D 29/324; F05D 2240/301; F05D 2250/70; F05D 2250/71
See application file for complete search history.

(56) References Cited

U.S. PATENT DOCUMENTS 4,919,593 A 4/1990 Brown
5,203,676 A 4/1993 Ferleger et al.
(Continued)

FOREIGN PATENT DOCUMENTS

DE 102005025213 A1 12/2006
EP 2299124 A1 3/2011
(Continued)

OTHER PUBLICATIONS

IPPR (PCT/416 and 409) dated Aug. 1, 2017, for PCT/EP2016/058559.
(Continued)

*Primary Examiner* — Erick R Solis
*Assistant Examiner* — Anthony L Bacon
(74) *Attorney, Agent, or Firm* — Beusse Wolter Sanks & Maire

(57) ABSTRACT

A method for profiling a turbine rotor blade for an axial flow machine, having the following steps: providing a geometric model of a blade profile, having a camber line of a profile section of the turbine rotor blade; determining boundary conditions for a flow flowing around the turbine rotor blade; changing the camber line such that the flow which is adjusted by the boundary conditions produces the maximum of the difference of the isentropic mach number between the pressure side and the suction side of the turbine rotor blade in a blade section which extends from the blade trailing edge in the direction towards the blade leading edge and the length of which is 65% of the length S of the blade chord.

14 Claims, 3 Drawing Sheets

(56) References Cited

U.S. PATENT DOCUMENTS

2003/0007872 A1* 1/2003 Bradbury ..... F04D 29/384 416/223 R
2006/0275134 A1* 12/2006 Hasenjager ..... F01D 5/141 416/237
2008/0025840 A1* 1/2008 Guemmer ..... F01D 5/141 416/183
2010/0215503 A1 8/2010 Myoren et al.
2011/0202321 A1* 8/2011 Lung ..... B64C 3/14 703/1
2011/0206527 A1* 8/2011 Harvey ..... F04D 29/324 416/223 R
2012/0163988 A1* 6/2012 Power ..... F01D 5/141 416/243
2012/0230834 A1 9/2012 Cornelius et al.
2013/0224004 A1* 8/2013 Radhakrishnan ..... F04D 29/444 415/191
2014/0154069 A1* 6/2014 Martinez-Botas Mateo ..... F01D 5/141 415/208.1
2014/0348648 A1* 11/2014 Hield ..... F01D 9/02 415/208.1
2015/0152880 A1 6/2015 Reiss et al.
2016/0061042 A1* 3/2016 Duong ..... F01D 5/141 416/243

FOREIGN PATENT DOCUMENTS

EP 2360377 A2 8/2011
JP H05340201 A 12/1993
JP 2010196563 A 9/2010
WO 2013178914 A1 12/2013

OTHER PUBLICATIONS

EP Search Report and Opinion dated Oct. 13, 2015, for EP patent application No. 15165330.0.
International Search Report dated Nov. 3, 2016, for PCT/EP2016/058559.

* cited by examiner

METHOD FOR PROFILING A TURBINE ROTOR BLADE

CROSS REFERENCE TO RELATED APPLICATIONS

This application is the US National Stage of International Application No. PCT/EP2016/058559 filed Apr. 18, 2016, and claims the benefit thereof. The International Application claims the benefit of European Application No. EP15165330 filed Apr. 28, 2015. All of the applications are incorporated by reference herein in their entirety.

FIELD OF INVENTION

The invention relates to a method for profiling a turbine rotor blade for an axial flow machine.

BACKGROUND OF INVENTION

The trend in the design of blades for an axial flow machine is toward increasing the aspect ratio of the blades and making the blades thinner. The blades designed in such a way tend to flutter during the operation of the axial flow machine. The fluttering is a self-induced vibration at the natural frequency of the blade. This vibration may be a longitudinal vibration of the blade with a vibration node at the root of the blade. Energy is thereby transferred from the fluid flowing in the axial flow machine to the blade. With repeated load changes of the axial flow machine, the fluttering may lead to material fatigue of the blade (high cycle fatigue). The material fatigue may lead to the formation of a crack and necessitate a cost-intensive replacement of the blade.

Fluttering is conventionally prevented by reducing the load acting on the blade. This however disadvantageously leads to a reduction in the efficiency of the axial flow machine. Furthermore, damping elements are conventionally provided, such as for example a shroud, which damps the fluttering of the blades. This however is a structurally complex solution. It would therefore be desirable to design the blade in such a way that it does not tend to flutter during the operation of the axial flow machine.

SUMMARY OF INVENTION

The object of the invention is to provide a method for profiling a blade for an axial flow machine in which the blade tends less to flutter.

The method according to the invention for profiling a turbine rotor blade for an axial flow machine has the steps of: providing a geometrical model of a blade profile, which has a mean camber line of a profile section of the turbine rotor blade; determining boundary conditions for a flow flowing around the turbine rotor blade; changing the mean camber line in such a way that the flow that is established by the boundary conditions produces the maximum of the difference of the isentropic Mach number between the pressure side and the suction side of the turbine rotor blade in a blade portion that extends from the blade trailing edge in the direction of the blade leading edge and the length of which is 65% of the length S of the blade chord. The mean camber line is the line of the profile section defined by points at the same distance from the pressure side as from the suction side. The blade chord denotes the path in the profile section from the blade leading edge to the blade trailing edge. Calculations have shown that, if the maximum of the difference of the isentropic Mach number is arranged in the blade portion according to the invention, the unstable pressure distribution changes in such a way that to the greatest extent local damping regions and local exciting regions compensate for one another. As a result, the blades designed in such a way tend much less to flutter than conventionally designed blades. The low tendency to flutter allows the blades to be subjected to greater loading than the conventionally designed blades. Moreover, there is advantageously no need for additional damping elements, such as for example a shroud, to be provided.

The mean camber line is formed by a first fourth-degree polynomial, which describes the mean camber line from the blade leading edge to an extreme point, and a second fourth-degree polynomial, which describes the mean camber line from the extreme point to the blade trailing edge, the extreme point being the point of the mean camber line that is at the maximum distance from the blade chord. The distance denotes the length of a path extending at right angles from the blade chord to the mean camber line. It is advantageous that the first polynomial is formed by using a leading-edge mean camber-line angle, which is the angle between the leading-edge tangent of the mean camber line and the blade chord, the length $x_{S1}$ from the blade leading edge to the point of the blade chord that is at the maximum distance from the mean camber line, and the length $S_1$, which is the distance from the extreme point to the blade chord, the second polynomial being formed by using a trailing-edge mean camber-line angle, which is the angle between the trailing-edge tangent of the mean camber line and the blade chord, the length $S-x_{S1}$ from the blade trailing edge to the point of the blade chord that is at the maximum distance from the mean camber line, and the length $S_2$, which is the distance from the mean camber line to the point of the blade chord that is at the distance $x_{S1}+0.5*(S-x_{S1})$ from the blade trailing edge, where S is the length of the blade chord. If a slope of zero is assumed for the extreme point, the first polynomial and the second polynomial are sufficiently determined by these parameters.

It is advantageous that the mean camber line is changed in such a way that $S_1$ is from 10.3% to 11.3% of the length S, $x_{S1}$ is from 35.1% to 38.4% of the length S of the blade chord, $S_2$ is from 64.8% to 67.9% of the length $S_1$, the trailing-edge mean camber-line angle is from 15.192° to 19.020° and the leading-edge mean camber-line angle is from 37.663° to 39.256°. It is advantageously ensured by these parameters that the blade has only a low tendency to flutter. The mean camber line is advantageously changed in such a way that $S_1$ is 10.8% of the length S, $x_{S1}$ is 36.8% of the length S, $S_2$ is 66.3% of the length $S_1$, the leading-edge mean camber-line angle is 17.106° and the trailing-edge mean camber-line angle is 38.460°. It is advantageously achieved by these parameters that the blade has a particularly low tendency to flutter.

It is alternatively advantageous that the turbine rotor blade has a transonic portion and the mean camber line in the transonic portion is changed in such a way that $S_1$ is from 7.6874% to 7.9% of the length S, $x_{S1}$ is from 35.4311% to 36.2% of the length S, $S_2$ is from 63% to 65% of the length $S_1$, the trailing-edge mean camber-line angle is from 11.0° to 12.3° and the leading-edge mean camber-line angle is from 29.0° to 31.0°. These parameters have the effect that a compression shock occurring during the operation of the axial flow machine under the boundary conditions occurs a long way downstream and with a low Mach number gradient. A fluttering turbine rotor blade causes disturbances in the flow. These disturbances may change the position of the compression shock that occurs at an adjacent turbine rotor blade. However, because the compression shock is arranged a long way downstream, the disturbances can only change the position of the compression shock to a small extent. As a result, a fluttering turbine rotor blade can only induce the fluttering of an adjacent turbine rotor blade to a small degree, as a result of which the overall fluttering tendency is low. In addition, the low Mach number gradient for the compression shock means that fluttering induced by the compression shock is advantageously reduced.

It is advantageous that the turbine rotor blade is free-standing. This means that no damping elements, such as for example a shroud, are provided.

It is advantageous that the geometrical model has a thickness that varies along the mean camber line, which is left the same during the changing of the mean camber line. Advantageously, here only the mean camber line is changed to reduce the tendency of the blade to flutter, which is advantageously a simple method with only few parameters to be changed.

It is advantageous that the boundary conditions of the flow are obtained from the nominal operating condition of the axial flow machine. It is also advantageous that it is a steady-state flow. The isentropic Mach numbers are advantageously determined experimentally and/or determined computationally. It is advantageous that the method is repeated for different profile sections of the turbine rotor blade. As a result, a design of the turbine rotor blade along its height takes place. The profile section advantageously lies on a cylinder surface or a cone surface of which the axes coincide with the axis of the axial flow machine, on an $S_1$ flow surface or in a tangential plane of the axial flow machine.

The axial flow machine is advantageously a gas turbine or a steam turbine. The method is advantageously carried out for profile sections that lie in the radially outer half of the turbine rotor blade; in particular, the method is only carried out for the profile sections that lie in the radially outer half of the turbine rotor blade.

The turbine rotor blade according to the invention for an axial flow machine has a blade profile that has a mean camber line of a profile section of the turbine rotor blade, the mean camber line being formed in such a way that, on the basis of boundary conditions for a flow flowing around the turbine rotor blade, the flow that is established produces the maximum of the difference of the isentropic Mach number between the pressure side and the suction side of the turbine rotor blade in a blade portion that extends from the blade trailing edge in the direction of the blade leading edge and the length of which is 65% of the length S of the blade chord.

It is advantageous that the mean camber line is formed by a first fourth-degree polynomial, which describes the mean camber line from the blade leading edge to an extreme point, and a second fourth-degree polynomial, which describes the mean camber line from the extreme point to the blade trailing edge, the extreme point being the point of the mean camber line that is at the maximum distance from the blade chord, the first polynomial being formed by using a leading-edge mean camber-line angle, which is the angle between the leading-edge tangent of the mean camber line and the blade chord, the length $x_{S1}$ from the blade leading edge to the point of the blade chord that is at the maximum distance from the mean camber line, and the length $S_1$, which is the distance from the extreme point to the blade chord, the second polynomial being formed by using a trailing-edge mean camber-line angle, which is the angle between the trailing-edge tangent of the mean camber line and the blade chord, the length $S-x_{S1}$ from the blade trailing edge to the point of the blade chord that is at the maximum distance from the mean camber line, and the length $S_2$, which is the distance from the mean camber line to the point of the blade chord that is at the distance $x_{S1}+0.5*(S-x_{S1})$ from the blade trailing edge, where S is the length of the blade chord.

It is advantageous that the mean camber line is made such that $S_1$ is from 10.3% to 11.3% of the length S, $x_{S1}$ is from 35.1% to 38.4% of the length S, $S_2$ is from 64.8% to 67.9% of the length $S_1$, the trailing-edge mean camber-line angle is from 15.192° to 19.020° and the leading-edge mean camber-line angle is from 37.663° to 39.256°. Alternatively, it is advantageous that the turbine rotor blade has a transonic portion and the mean camber line in the transonic portion is made such that $S_1$ is from 7.6874% to 7.9% of the length S, $x_{S1}$ is from 35.4311% to 36.2% of the length S, $S_2$ is from 63% to 65% of the length $S_1$, the trailing-edge mean camber-line angle is from 11.0° to 12.3° and the leading-edge mean camber-line angle is from 29.0° to 31.0°.

The axial flow machine according to the invention has a turbine rotor blade according to the invention, the turbine rotor blade being free-standing and the axial flow machine being in particular a gas turbine or a steam turbine.

BRIEF DESCRIPTION OF THE DRAWINGS

The invention is explained in more detail below on the basis of the accompanying schematic drawings, in which.

DETAILED DESCRIPTION OF INVENTION

Figure 1:
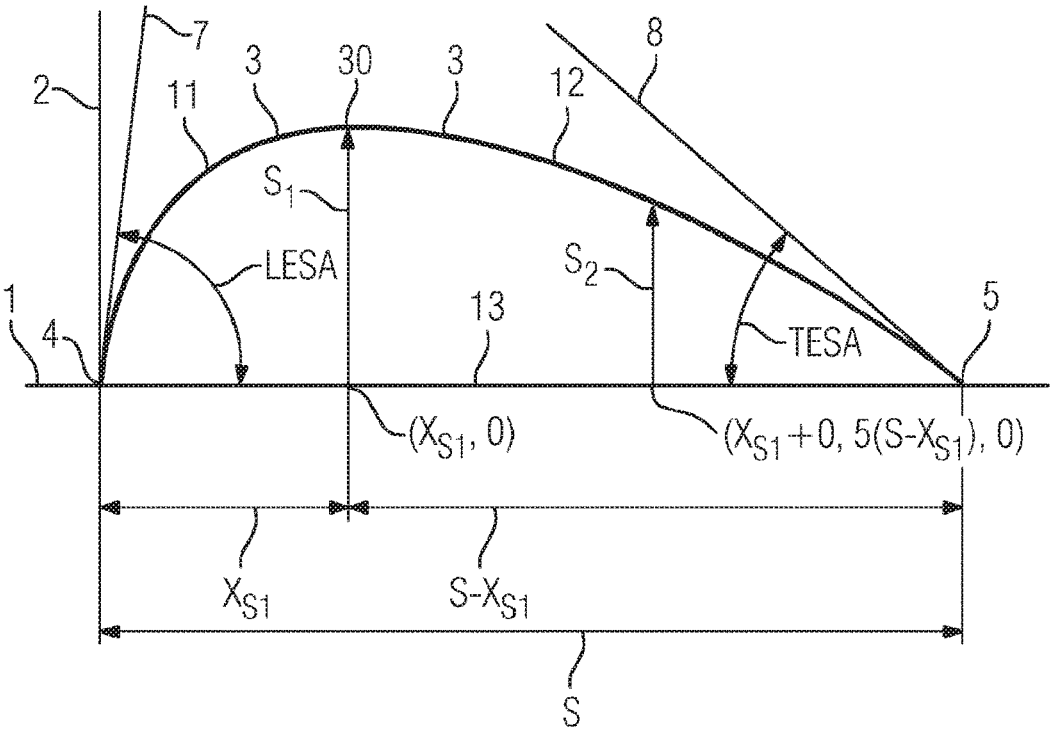
FIG. 1 shows a geometrical model of a profile section.

FIG. 1 shows a geometrical model of a profile section of a turbine rotor blade for an axial flow machine, which is for example a gas turbine or a steam turbine. The profile section lies for example on a cylinder surface or a cone surface of which the axes coincide with the axis of the axial flow machine, on an $S_1$ flow surface or in a tangential plane of the axial flow machine.

As can be seen from FIG. 1, the geometrical model has a curved mean camber line 3, which is the line of the profile section defined by points at the same distance from the pressure side as from the suction side of the turbine rotor blade. It can also be seen from FIG. 1 that the turbine rotor blade has a blade leading edge 4 and a blade trailing edge 5. The blade leading edge 4 and the blade trailing edge 5 bound the mean camber line 3. The path between the blade leading edge 4 and the blade trailing edge 5 is the blade chord 13. The geometrical model is depicted in FIG. 1 in a plot of which the x axis 1 coincides with the blade chord 13 and over the y axis of which the distance of the mean camber line 3 from the blade chord 13 is plotted. The distance denotes the length of a path extending at right angles from the blade chord 13 to the mean camber line. The system of coordinates in FIG. 1 is chosen such that the blade leading edge 4 coincides with the origin of the system of coordinates. The blade trailing edge 5 lies at the point (S,0), where S is the length of the blade chord 13.

The mean camber line 3 is formed by a first fourth-degree polynomial 11 and a second fourth-degree polynomial 12. The first polynomial 11 describes the mean camber line 3 from the blade leading edge 4 to an extreme point 30. The extreme point 30 is the point of the mean camber line 3 that is at the maximum distance from the blade chord 13. The second polynomial 12 describes the mean camber line 3 from the extreme point 30 to the blade trailing edge 5. Likewise depicted in FIG. 1 is a leading edge tangent 7, which is the tangent of the mean camber line 3 to the blade leading edge 4. The leading edge tangent 7 forms with the blade chord 13 a leading-edge mean camber-line angle LESA. Also depicted in FIG. 1 is a trailing edge tangent 8, which is the tangent of the mean camber line 3 to the blade trailing edge 5. The trailing edge tangent 8 forms with the blade chord 13 a trailing-edge mean camber-line angle TESA.

The first polynomial 11 is formed by choosing the leading-edge mean camber-line angle LESA, the length $x_{S1}$ from the blade leading edge 4 to the point $(x_{S1},0)$ on the blade chord 13 that is at the maximum distance from the mean camber line 13, and the length $S_1$, which is the distance from the point $(x_{S1},0)$ to the extreme point 30. The fact that the slope of the extreme point 30 is zero and the blade leading edge 4 lies at the origin of the system of coordinates means that the first polynomial 11 is sufficiently determined. The second polynomial 12 is formed by choosing the trailing-edge mean camber-line angle TESA, the length $S-x_{S1}$ from the blade trailing edge 5 to the point $(x_{S1},0)$ on the blade chord 13, and the length $S_2$, which is the distance from the point $(x_{S1}+0.5*(S-x_{S1}),0)$ to the mean camber line 3. The fact that the slope of the extreme point 30 is zero and the blade trailing edge 5 lies at the point (S,0) means that the second polynomial 12 is sufficiently determined.

In the method for profiling the blade, the geometrical model of the blade profile is provided in the way described for FIG. 1. Boundary conditions for a flow flowing around the blade are provided. The boundary conditions can be obtained for example from the nominal operating conditions of the axial flow machine. The mean camber line 3 is changed in such a way that the flow that is established by the boundary conditions produces the maximum of the difference of the isentropic Mach number 22 to 25 between the pressure side and the suction side of the turbine rotor blade 14, 15 in a blade portion that extends from the blade trailing edge 5 in the direction of the blade leading edge 4 and the length of which is 65% of the length S of the blade chord.

Figure 2:
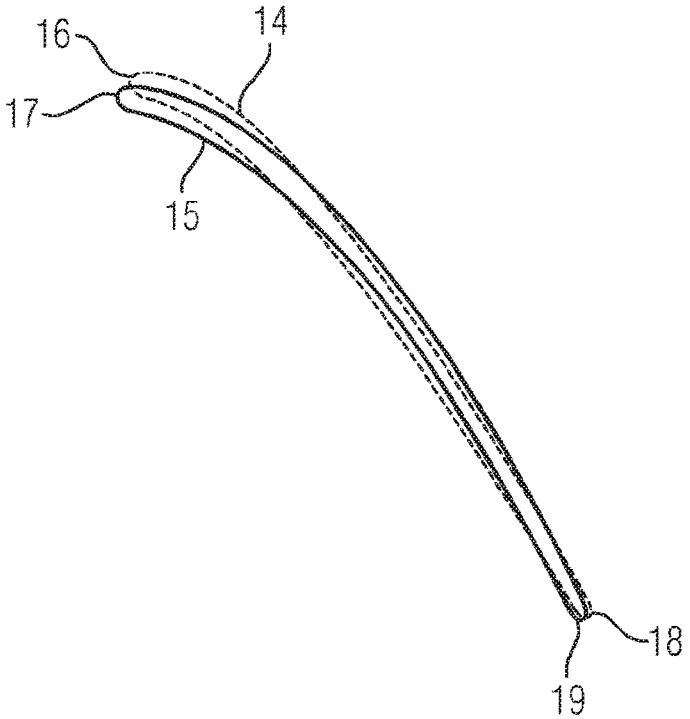
FIG. 2 shows a profile section of a conventional turbine rotor blade and of a turbine rotor blade designed according to the invention.

FIG. 2 shows a turbine rotor blade 14, which is conventionally designed, and a blade 15, which is designed according to the invention. The conventionally designed blade 14 has a blade leading edge 16 and a blade trailing edge 18. After changing the mean camber line 3, the blade 15 designed according to the invention is obtained. The blade 15 designed according to the invention has a blade leading edge 17 and a blade trailing edge 19. It can be seen from FIG. 2 that, after changing the mean camber line 3, the turbine rotor blade 15 designed according to the invention has a more curved mean camber line 3 than the conventionally designed blade 14.

In order to achieve the effect that the maximum of the difference of the isentropic Mach number is in the blade portion according to the invention, the parameters describing the first polynomial 11 and the second polynomial 12 may assume for example the following values:

| | Mean value | Lower limit | Upper limit |
|---|---|---|---|
| $S_1/S$ | 0.108 | 0.113 | 0.103 |
| $x_{S1}/S$ | 0.368 | 0.384 | 0.351 |
| $S_2/S_1$ | 0.663 | 0.679 | 0.648 |
| TESA/° | 17.106 | 19.020 | 15.192 |
| LESA/° | 38.460 | 39.256 | 37.663 |

Figure 3:
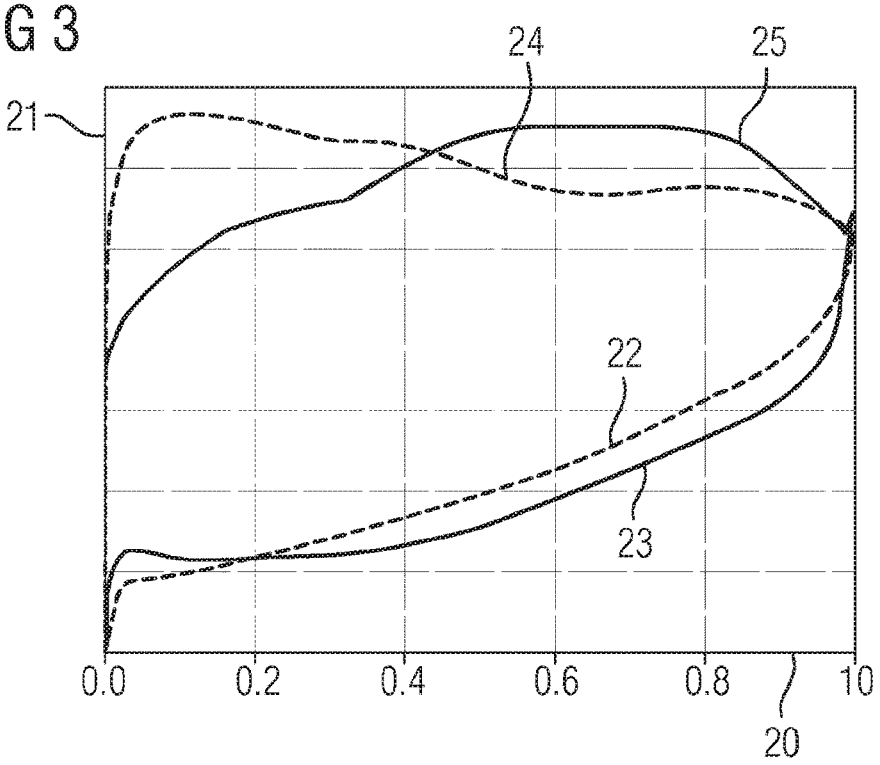
FIG. 3 shows a plot of an isentropic Mach number variation of a conventional turbine rotor blade and of a turbine rotor blade designed according to the invention.

FIG. 3 shows a plot over the x axis 20 of which the length of the blade chord 13 is plotted and over the y axis 21 of which the isentropic Mach number is plotted. FIG. 3 shows a Mach number variation 22 on the pressure side and a Mach number variation 24 on the suction side of the conventionally designed blade 14. Likewise shown is a Mach number variation 23 on the pressure side and a Mach number variation 25 on the suction side of the turbine rotor blade 15 designed according to the invention. The Mach number variations 22 to 25 were determined computationally. For this purpose, the Navier-Stokes equations for the steady state of the given problem were solved.

The Mach number variations 22 to 25 show that, for the conventionally designed turbine rotor blade, the difference of the Mach number variations 25 and 23 is greater in the front region of the blade 14 than in the rear region of the turbine rotor blade 14. By contrast, the difference of the Mach number variations 24 and 22 for the blade 15 profiled according to the invention is greater in the rear region of the turbine rotor blade 15 than in the front region of the turbine rotor blade 15. The maximum of the difference of the turbine rotor blade 15 designed according to the invention is located substantially at a length of the blade chord 13 of 0.5*S.

Figure 4:
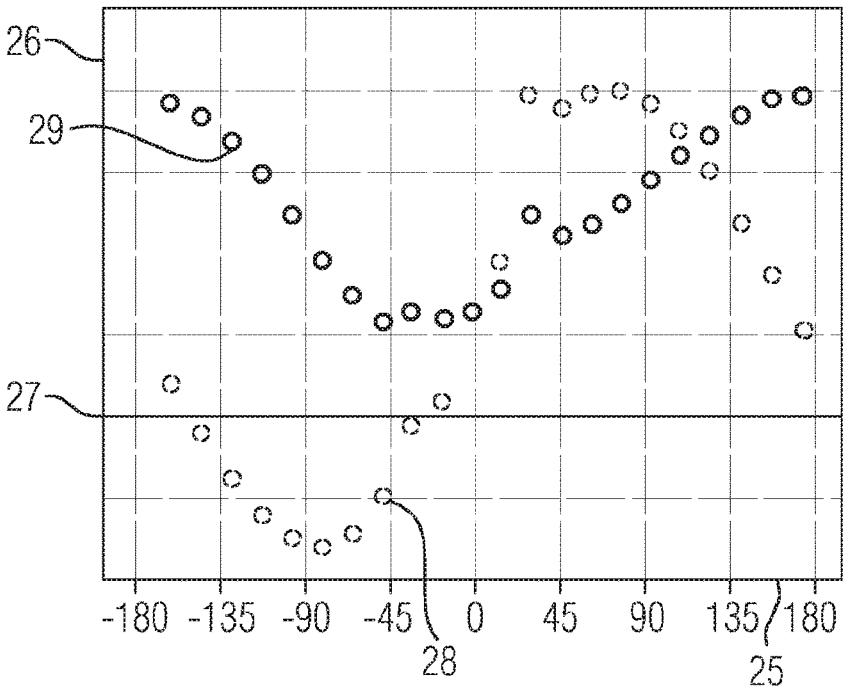
FIG. 4 shows a damping value variation of a conventional turbine rotor blade and of a turbine rotor blade designed according to the invention.

FIG. 4 shows a plot in which the phase angle between two adjacent turbine rotor blades (interblade phase angle) is plotted over the x axis 25. An aerodynamic damping value is plotted over the y axis 26 of FIG. 4. Likewise depicted is a zero line 27, at which the aerodynamic damping value assumes the value zero. In order to determine whether the turbine rotor blade is damped or excited, the linearized Navier-Stokes equations are solved for each phase difference angle and the aerodynamic damping value is calculated. FIG. 4 shows a damping value variation 28 for the conventionally designed turbine rotor blade 14 and a damping value variation 29 for the turbine rotor blade 15 designed according to the invention. The damping value variation 28 also assumes negative values, which means that the conventionally designed turbine rotor blade 14 has a self-induced fluttering vibration during the operation of the axial flow machine. The damping value variation 29, however, has a positive value for all phase difference angles, which means that the blade 15 designed according to the invention has no self-induced fluttering vibration during the operation of the axial flow machine.

In order to achieve the effect that the maximum of the difference of the isentropic Mach number is in the blade portion according to the invention, in the case of an alternative turbine rotor blade the parameters describing the first polynomial 11 and the second polynomial 12 may alternatively assume for example the following values in a transonic portion of a turbine rotor blade:

| | Mean value | Lower limit | Upper limit |
|---|---|---|---|
| $S_1/S$ | 0.07765 | 0.076874 | 0.079 |
| $x_{S1}/S$ | 0.35789 | 0.354311 | 0.362 |
| $S_2/S_1$ | 0.64042 | 0.63 | 0.65 |

-continued

| | Mean value | Lower limit | Upper limit |
|---|---|---|---|
| TESA/° | 11.9162 | 11.0 | 12.3 |
| LESA/° | 29.9933 | 29.0 | 31.0 |

Figure 5:
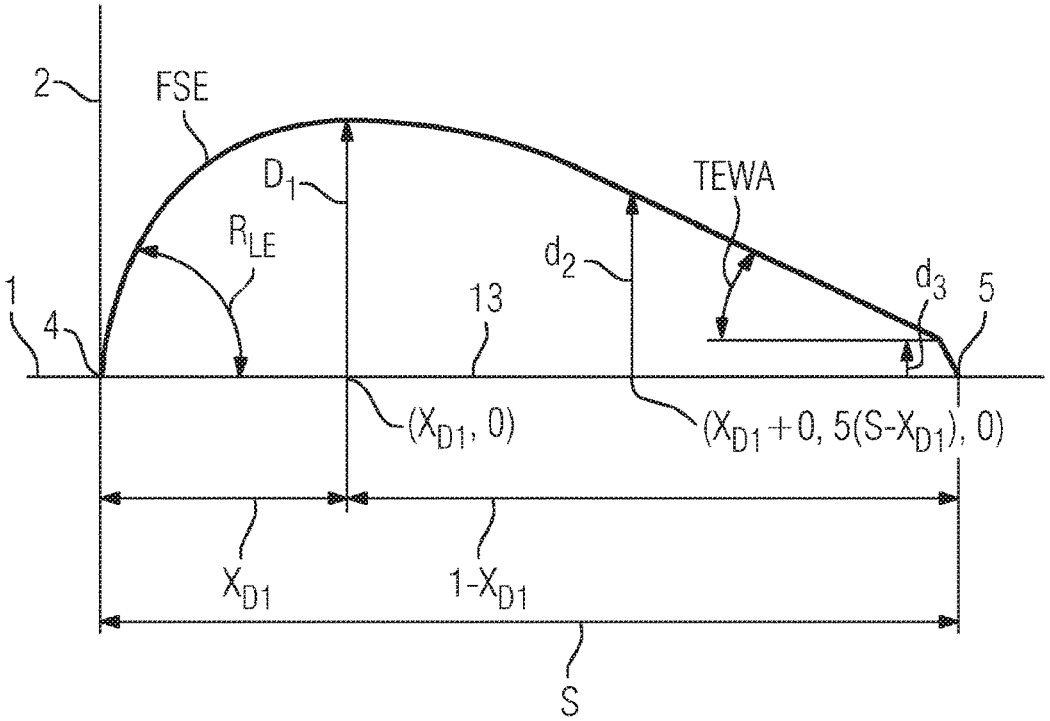
FIG. 5 shows a thickness distribution of a profile section and FIG. 6 shows a damping value variation of a conventional turbine rotor blade and of an alternative turbine rotor blade designed according to the invention.

FIG. 5 shows a thickness distribution of the alternative turbine rotor blade. The thickness distribution is depicted in FIG. 5 in a plot of which the x axis 1 coincides with the blade chord 13 and over the y axis of which the thickness of the alternative turbine rotor blade is plotted. The thickness distribution d(t) is formed by a polynomial of the form $$d(t)=a_0\cdot t^{FSE}+a_1\cdot t+a_2\cdot t^2+a_3\cdot t^3,$$

where t goes from 0 to 1, the blade leading edge 4 lying at 0 and the blade trailing edge lying at 1. The polynomial is formed by choosing the leading-edge radius of curvature $R_{LE}$, the length $x_{D1}$ from the blade leading edge 4 to the point ($x_{D1}$,0) on the blade chord 13, at which there is the maximum thickness D1 of the alternative turbine rotor blade, the thickness d2, which is the thickness of the alternative turbine rotor blade at the point ($x_{D1}$+0.5*(S-$x_{D1}$), 0), and the trailing-edge wedge angle TEWA. The blade also has at the blade trailing edge 5 a portion tapering to a point toward the blade trailing edge 5, which starts from a thickness $d_3$ and falls to zero. The thickness d3 may be in a range from 96% to 99.9% of S.

The aforementioned variables may assume the following values:

| | Mean value | Lower limit | Upper limit |
|---|---|---|---|
| D1/S | 0.113590 | 0.10 | 0.12 |
| $X_{D1}$/S | 0.282520 | 0.27 | 0.29 |
| $d_2/D_1$ | 0.681520 | 0.66 | 0.70 |
| $d_3$/S | 0.017010 | 0.016 | 0.018 |
| TEWA/° | 3.440010 | 3.37 | 3.51 |
| $R_{LE}$ | 0.020430 | 0.019 | 0.021 |
| FSE | 0.5 | 0.501 | 0.499 |

Figure 6:
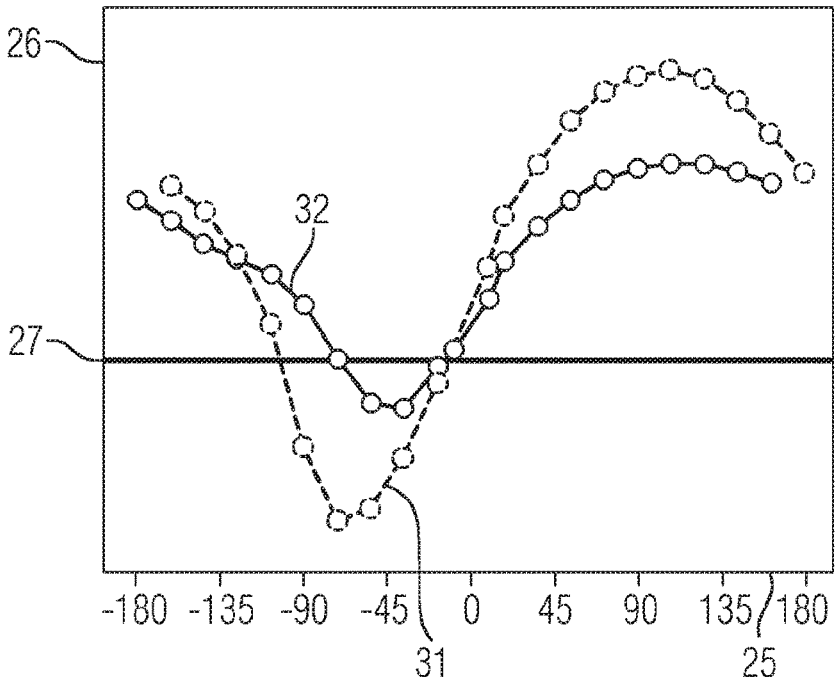

FIG. 6 shows a damping value variation 31 for a conventionally designed turbine rotor blade and a damping value variation 32 for the alternative turbine rotor blade designed according to the invention. The damping value variation 32 assumes negative values to a lesser extent than the damping value variation 31, as a result of which the alternative turbine rotor blade tends less to flutter than the conventional turbine rotor blade.

Although the invention has been more specifically illustrated and described in detail by the preferred exemplary embodiment, the invention is not restricted by the disclosed examples and other variations can be derived herefrom by a person skilled in the art without departing from the scope of protection of the invention.

The invention claimed is:

1. A method for profiling a turbine rotor blade for an axial flow machine, comprising:

providing a geometrical model of a blade profile, which has a mean camber line of a profile section of the turbine rotor blade;

determining boundary conditions for a flow flowing around the turbine rotor blade;

changing the mean camber line in such a way that the flow that is established by the boundary conditions produces the maximum of the difference of the isentropic Mach number between the pressure side and the suction side of the turbine rotor blade in a blade portion that extends from the blade trailing edge in the direction of the blade leading edge and the length of which is 65% of the length S of the blade chord, wherein the mean camber line is formed by a first fourth-degree polynomial, which describes the mean camber line from the blade leading edge to an extreme point, and a second fourth-degree polynomial, which describes the mean camber line from the extreme point to the blade trailing edge, and wherein the extreme point is the point of the mean camber line that is at the maximum distance from the blade chord.

2. The method as claimed in claim 1, wherein the first polynomial is formed by using a leading-edge mean camber-line angle, which is the angle between the leading-edge tangent of the mean camber line and the blade chord, the length $x_{S1}$ from the blade leading edge to the point of the blade chord that is at the maximum distance from the mean camber line, and the length $S_1$, which is the distance from the extreme point to the blade chord, wherein the second polynomial is formed by using a trailing-edge mean camber-line angle, which is the angle between the trailing-edge tangent of the mean camber line and the blade chord, the length S-$x_{S1}$ from the blade trailing edge to the point of the blade chord that is at the maximum distance from the mean camber line, and the length $S_2$, which is the distance from the mean camber line to the point of the blade chord that is at the distance $x_{S1}$+0.5*(S−$x_{S1}$) from the blade trailing edge, where S is the length of the blade chord.

3. The method as claimed in claim 2, wherein the mean camber line is changed in such a way that $S_1$ is from 10.3% to 11.3% of the length S, $x_{S1}$ is from 35.1% to 38.4% of the length S, $S_2$ is from 64.8% to 67.9% of the length $S_1$, the trailing-edge mean camber-line angle is from 15.192° to 19.020° and the leading-edge mean camber-line angle is from 37.663° to 39.256°.

4. The method as claimed in claim 2, wherein the turbine rotor blade has a transonic portion and the mean camber line in the transonic portion is changed in such a way that $S_1$ is from 7.6874% to 7.9% of the length S, $x_{S1}$ is from 35.4311% to 36.2% of the length S, $S_2$ is from 63% to 65% of the length $S_1$, the trailing-edge mean camber-line angle is from 11.0° to 12.3° and the leading-edge mean camber-line angle is from 29.0° to 31.0°.

5. The method as claimed in claim 1, wherein the turbine rotor blade is free-standing.

6. The method as claimed in claim 1, wherein the geometrical model has a thickness that varies along the mean camber line, which is left the same during the changing of the mean camber line.

7. The method as claimed in claim 1, wherein the boundary conditions of the flow are obtained from the nominal operating condition of the axial flow machine.

8. The method as claimed in claim 1, wherein the isentropic Mach numbers are determined experimentally and/or are determined computationally.

9. The method as claimed in claim 1, wherein the method is repeated for different profile sections of the turbine rotor blade.

10. The method as claimed in claim 1, wherein the profile section is laid on a cylinder surface or a cone surface of which the axes coincide with the axis of the axial flow machine, on an $S_1$ flow surface or in a tangential plane of the axial flow machine.

11. The method as claimed in claim 1, wherein the axial flow machine is a gas turbine or a steam turbine.

12. The method as claimed in claim 1, wherein the method is carried out for profile sections that lie in the radially outer half of the turbine rotor blades.

13. A turbine rotor blade for an axial flow machine, comprising:

a blade profile that has a mean camber line of a profile section of the turbine rotor blade, the mean camber line being formed in such a way that, on the basis of boundary conditions for a flow flowing around the turbine rotor blade, the flow that is established produces the maximum of the difference of the isentropic Mach number between the pressure side and the suction side of the turbine rotor blade in a blade portion that extends from the blade trailing edge in the direction of the blade leading edge and the length of which is 65% of the length S of the blade chord, wherein the mean camber line is formed by a first fourth-degree polynomial, which describes the mean camber line from the blade leading edge to an extreme point, and a second fourth-degree polynomial, which describes the mean camber line from the extreme point to the blade trailing edge, wherein the extreme point is the point of the mean camber line that is at the maximum distance from the blade chord, wherein the first polynomial is formed by using a leading-edge mean camber-line angle, which is the angle between the leading-edge tangent of the mean camber line and the blade chord, the length $x_{S1}$ from the blade leading edge to the point of the blade chord that is at the maximum distance from the mean camber line, and the length $S_1$, which is the distance from the extreme point to the blade chord, wherein the second polynomial is formed by using a trailing-edge mean camber-line angle, which is the angle between the trailing-edge tangent of the mean camber line and the blade chord, the length $S-x_{S1}$ from the blade trailing edge to the point of the blade chord that is at the maximum distance from the mean camber line, and the length $S_2$, which is the distance from the mean camber line to the point of the blade chord that is at the distance $x_{S1}+0.5*(S-x_{S1})$ from the blade trailing edge, where S is the length of the blade chord, wherein the mean camber line is made such that $S_1$ is from 10.3% to 11.3% of the length S, $x_{S1}$ is from 35.1% to 38.4% of the length S, $S_2$ is from 64.8% to 67.9% of the length $S_1$, the trailing-edge mean camber-line angle is from 15.192° to 19.020° and the leading-edge mean camber-line angle is from 37.663° to 39.256°, or the turbine rotor blade having a transonic portion and the mean camber line in the transonic portion is made such that $S_1$ is from 7.6874% to 7.9% of the length S, $x_{S1}$ is from 35.4311% to 36.2% of the length S, $S_2$ is from 63% to 65% of the length $S_1$, the trailing-edge mean camber-line angle is from 11.0° to 12.3° and the leading-edge mean camber-line angle is from 29.0° to 31.0°.

14. An axial flow machine with a turbine rotor blade as claimed in claim 13, wherein the turbine rotor blade is free-standing and the axial flow machine is a gas turbine or a steam turbine.

* * * * *